United States Patent [19]

Ratte

[11] Patent Number: 4,662,205

[45] Date of Patent: May 5, 1987

[54] MACHINE FOR COLD DIE CASTING MALLEABLE METALS

[76] Inventor: Robert W. Ratte, 18 Oriole La., North Oaks, Minn. 55110

[21] Appl. No.: 789,651

[22] Filed: Oct. 21, 1985

[51] Int. Cl.[4] ..... B21D 22/00

[52] U.S. Cl. ..... 72/359; 72/358; 72/336; 72/337

[58] Field of Search ..... 72/270, 358, 359, 335, 72/336, 339

[56] References Cited

U.S. PATENT DOCUMENTS 3,333,455 8/1967 Ratte et al. ..... 72/354

4,312,210 1/1982 Nishizawa ..... 72/270

*Primary Examiner*—R. L. Spruill

*Assistant Examiner*—David B. Jones

*Attorney, Agent, or Firm*—Jacobson and Johnson

[57] ABSTRACT

A separable die block contains a cavity for shaping a part from a slug of cylindrical malleable metal and a cylindrical injector for injecting the slug of metal into the die block cavity, the injector having an outer sleeve and a coaxial inner pin which are axially moveable with respect to one another for forming an opening or a recess in the part. As a further feature, a moveable plunger in the die block is in communication with the die block cavity for further altering the shape of the formed part, if desired.

4 Claims, 9 Drawing Figures

MACHINE FOR COLD DIE CASTING MALLEABLE METALS

FIELD OF THE INVENTION

This invention is directed toward a machine for cold die casting malleable metals. More particularly, it is directed toward that part of the machine which operates in conjunction with the cavity in the die block which can be used for altering the shape of the article or part that is formed.

DESCRIPTION OF THE PRIOR ART

U.S. Pat. No. 3,333,455 dated Aug. 1, 1967 describes in detail the operation of a cold die casting machine and how a part is formed using a machine of this nature. The aforementioned patent explains some of the features and advantages of forming parts or articles by cold die casting and those same features and advantages are equally applicable with respect to the instant invention. Additionally, the aforementioned patent describes how a cylindrical slug of metal is cut to a prescribed size and then inserted into an injection chamber for being injected into the die mold. The same operation is used in the instant invention. Further, the aforementioned patent describes using a separable mold or die block which is opened to eject the formed part and which is closed together when the slug is being injected and the part formed with the injection port being through a wall of the die block other than along the die block separation line. The instant invention operates in the same fashion.

SUMMARY OF THE INVENTION

The cylindrical injector which injects the slug of malleable metal into the die block has an outer cylindrical sleeve or punch member and a coaxial inner core or pin member which are axially moveable with respect to one another. This permits the part which is formed by the die cavity to be further altered if desired. For example, after the slug of metal is injected and impacts the wall of the die cavity, the core or pin can be further advanced to form a recess in the part and at the same time the sleeve or punch is allowed to withdraw to accommodate the excess metal flow resulting from the further pin entry. Further variations to the formed part can be obtained by providing a plunger through the wall of the die cavity opposite the injection port and as the pin is advanced to form a recess in the formed part, the plunger can be allowed to be withdrawn to accommodate the excess metal flow caused by the pin advancement. As still a further feature, the plunger can be constructed similar to the injector and the plunger sleeve and/or pin can be withdrawn as the injector sleeve and/or pin advances into the die block.

DESCRIPTION OF THE PREFERRED EMBODIMENTS

In a cold die casting machine a volume of malleable metal is injected into the cavity or mold defined in the interior of a die block with a suitable compression force such that when the metal strikes the cavity defining wall surface of the die block it is formed into a homogeneous mass in the shape or contour of the cavity. The volume of material that is injected is equal to the volume of metal in the desired formed part so, therefore, the amount can be readily predetermined and measured. No pre-treatment, such as heating to soften the metal, is required.

Figure 9:
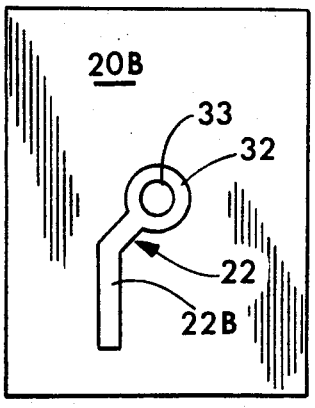
FIG. 9 is a plan view of the face of a section of the die block of FIG. 7 showing the shape of the cavity.

Referring now to the schematic illustrations of FIGS. 1–5, a die block 20 is made of two parts, a moveable die block section 20A and a fixed die block section 20B normally closed together along a separation line 21. As is common practice, the die block needs a moveable section in order to open the die block so that the formed part can be ejected. In describing the instant invention for simplification the opening and closing of the die block will not be further described nor is it considered to be a part of the instant invention but it should be kept in mind that it is essential to the operation of a cold die casting machine. The die block contains a cavity 22, which, in this embodiment, comprises a cylindrical section 22A and a leg section 22B extending radially outward from the cylindrical section. The shape of the die cavity 22 is illustrated most clearly in FIG. 9. The cavity 22 is formed on the inner face of the fixed die block section 20B and the inner face of the moveable die block section 20A has an opening or port 23 which is closed with a cylindrical plunger 24 having its inner end flush with the inner face of the moveable die block section 20A. Normally plunger 24 is kept in this position by a suitable force being applied so that the inner face of the moveable die block section 20A appears as a solid, continuous, planer, interior wall.

Similar to the machine illustrated in U.S. Pat. No. 3,333,455 an elongated rod or wire 25 of malleable metal such as aluminum, copper or lead, for example, having a uniform cross-section along its length is transported from a source, not shown, down a passageway to the fixed die block 20B and a predetermined length thereof is severed from rod 25 to form a cylindrical slug 26 by a cutting die 27 as it passes downward to place the slug 26 into injection chamber 28. The required length to be cut off of wire 25 is readily determined knowing the cross-section dimension and the volume of the cavity which is to be filled. After the slug 26 is seated in the injection chamber 28 cylindrical injector 30 advances the slug into the die block 20 through an injection port 31. Injector 30 has an outer sleeve or punch member 32 and a coaxial pin or core member 33 which are axially slidably moveable with respect to one another. The slug 26 is injected with sufficient force and pressure applied by the injector 30 so that the metal flows from the point of impact with the inner face or wall of the moveable die block 20A to completely fill the cylindrical section 22A and the radial extension section 22B of the cavity in the die block. Those of ordinary skill in the art of cold die casting will readily understand that the amount of applied force depends upon various factors. As explained and described in U.S. Pat. No. 3,333,455 the foremost factor is the malleability of the injected material. More malleable metals such as lead and lead alloys require less amount of compression force than less malleable metals such as copper and aluminum-based metals. The less malleable metals have to be injected at a high velocity to impact the wall of the die block with an explosive-like force to initiate the cold flow of the metal. A constant force is applied thereafter in both cases to cause the metal to continue to flow and fill the cavity in a homogeneous mass. Also, the force and velocity of the injection depends upon the size and the shape of the part to be formed.

Figure 1:
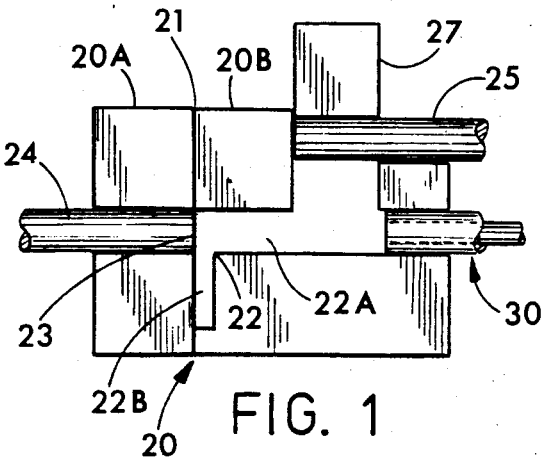
FIGS. 1–5 schematically illustrate the operation of an embodiment of the invention.
Figure 2:
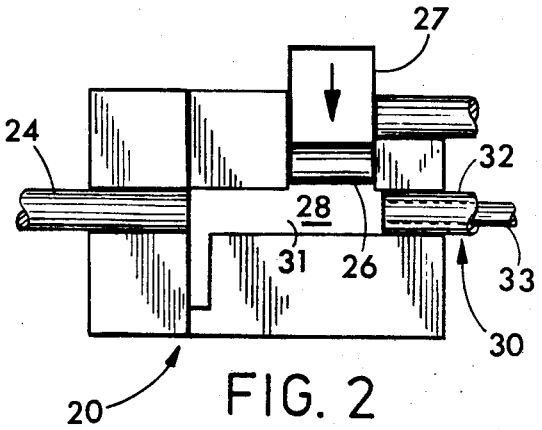
Figure 3:
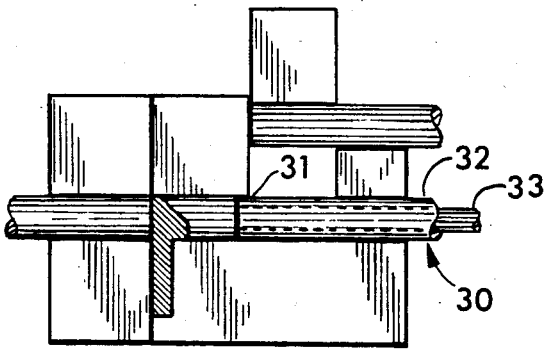
Figure 4:
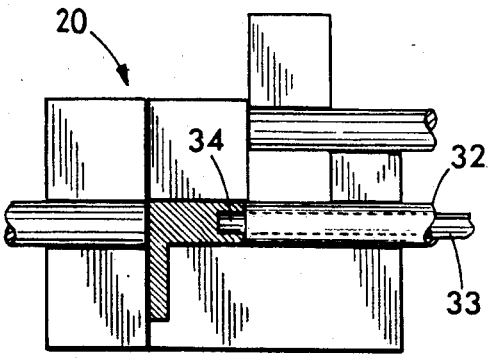
Figure 5:
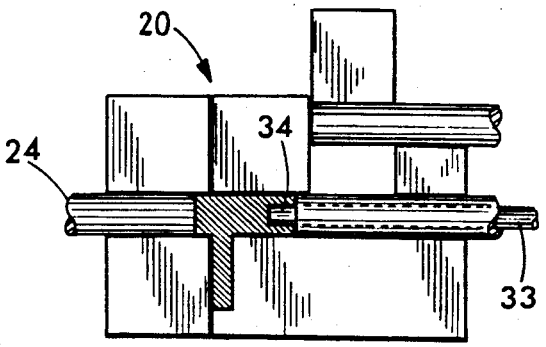

As illustrated in FIG. 4, after the metal has substantially filled cavity 22, the core 33 of injector 30 may be advanced further into the die block to form a recess 34 in one end of the cylindrical section of the formed part. To accommodate the additional metal flow caused by the advancement of the core 33 the sleeve or punch 32 of the injector 30 is allowed to withdraw with some pressure or force still being applied, by means not shown. Alternatively, as illustrated in FIG. 5, when the core 33 is advanced to form the recess 34 plunger 24 may be allowed to withdraw from the die block wall to accommodate the excess metal flow caused by the further injection of core 33 and to form a hub on the other end of the cylindrical section of the formed part.

Figure 6:
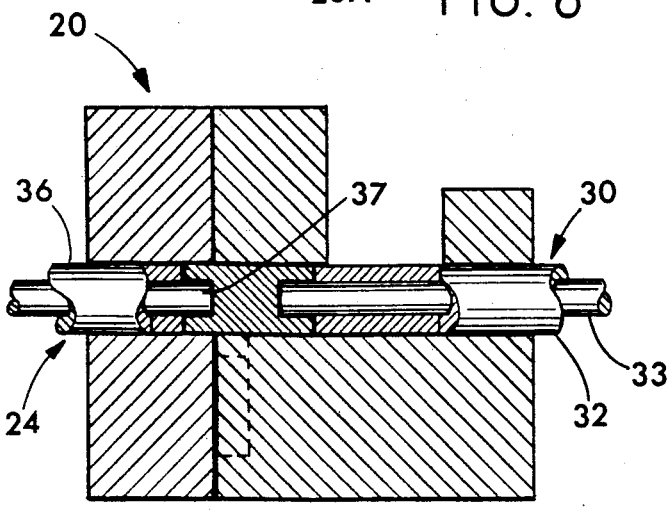
FIG. 6 is a schematic illustration similar to FIGS. 1–5 illustrating another embodiment.

FIG. 6 illustrates in schematic form a variation of the embodiment of the invention shown in FIGS. 1–5. In FIG. 6 plunger 24 is constructed similar to injector 30 with an outer sleeve 36 and an inner pin member 37. The inner pin member 37 can be moved axially with respect to the outer sleeve 36 in a fashion similar to that described with respect to injector 30 so that the pin can be further injected to form a recess at the opposite end of the cylindrical portion of the formed part. It should be obvious that various combinations can be utilized such as where the injector 30 is a solid metal cylinder and plunger 24 has the sleeve and pin combination or where both have sleeve and pin members.

Figure 7:
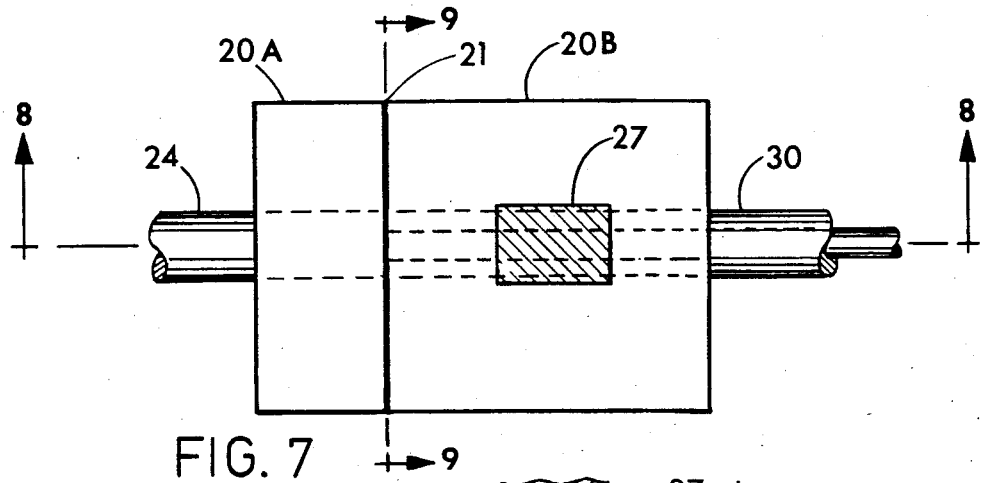
FIG. 7 is a top plan view of the die block in an embodiment of the invention.
Figure 8:
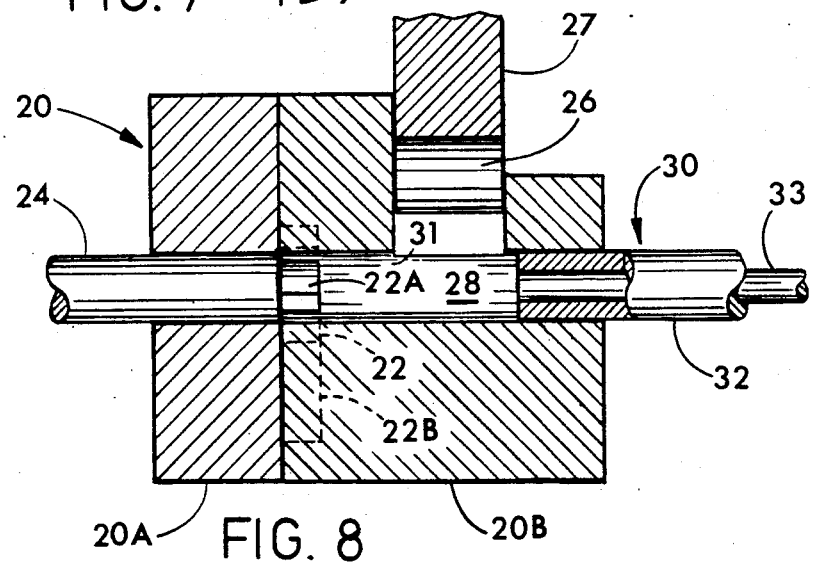
FIG. 8 is a vertical sectioned view of the die block of FIG. 7.

FIG. 7 is a top plan view of the die block 20 with the moveable section 20A and the fixed section 20B closed together at separation line 21 and with injector 30 and plunger 24 inserted and cutting die 27 in place. As viewed along vertical section line 8—8 of FIG. 7, the details of the interior of the die block with the associated injector and plunger are shown in FIG. 8. The cutting die 27 carries slug 26 down to the injection chamber 28 to place it in line with the cylindrical injector 30 which is poised to inject the slug 26 through the injection port 31 into cavity 22 in die block 20. The cavity has a cylindrical portion 22A and radial extension therefrom 22B. Plunger 24 is located opposite injector 30 and in axial alignment therewith through an opening in the moveable die block section 20A. The shape and form of cavity 22 can be seen most clearly in FIG. 9 which is a view taken along the separation line 21 looking at the face of the fixed die block section 20B.

While it should be understood that suitable means must be provided for moving the moveable die block section, the plunger and the injector with sufficient force and correct timing to form the part as described, said means do not constitute a part of this invention and are known to those of skill in the art of cold die casting. Typically, as described in U.S. Pat. No. 3,333,455, injector 30 plunger 24 and the moveable die block 20 may be suitably linked to a cam follower engaged with a track on a rotating cam. For example, core member 33 may be linked to a cam follower on a first cam surface and punch member 32 may be linked to a cam follower engaged in a second cam surface. The cam surfaces would be contoured to move both the sleeve member 32 and the pin or core member 33 in unison into the injection chamber and toward the injection port of the die block initially to force the slug of lead or other malleable material 26 with sufficient force into the die block 20 so that it flows to fill the cavity 22 upon impact. The cam surface for the pin member 33 would be contoured to then further advance the pin member into the die block to form the recess in the cylindrical section of the formed part and at the same time, the cam surface for the sleeve member 32 would be shaped to permit the sleeve to move outward from the cavity while still maintaining a force or pressure to keep the injector port closed while permitting the additional flow of metal to follow around the injector pin 33. At the same time a suitable cam with cam follower may be linked to the moveable die block section 20A to close it and hold it closed with sufficient force to bear up against the impact of the injected slug. Similarly yet another cam would be provided and linked to the plunger 24 to move it along with the moveable die block 20A. To operate in accordance with the illustration of FIG. 5 the cam surface of the cam for the plunger 24 would then be shaped to permit the plunger 24 to be withdrawn away from the die cavity while pin 33 is advancing but yet retaining a pressure or force on plunger 24. In the embodiment illustrated in FIG. 6 wherein the plunger 24 has a sleeve and pin member 36 and 37, respectively, each of said members would be coupled to a suitable cam to control the movements of the member into and out of the die block.

It should also be understood that those of skill in the art of die casting recognize that some means must also be provided for ejecting the formed part from the die block. Ordinarily, for example, this may be done by a pin or series of pins passing through the die block into the cavity being operated by some convenient mechanism which moves the pin or pins into the die block cavity after the part has been formed and while the moveable die block section is opened to push or eject the part out of the cavity so it is allowed to fall by gravity into a collecting station.

I claim:

1. In a machine for cold die forming malleable metal:

a die block having a closeable interior cavity for receiving and shaping a slug of cold malleable metal said cavity having a cylindrical section and a further cavity section in communication with and extending radially outward from said cylindrical cavity section and an injection port through a wall of the die block in communication with the cylindrical section of said die block cavity;

an injection chamber in line with said injection port;

means for placing a slug of malleable metal in said injection chamber; and injector means aligned with said injection chamber for injecting a slug of malleable metal in said injection chamber into the die cavity through said injection port, said injector means comprising an outer cylindrical punch member with an axial bore therethrough and a core member slidably moveable axially in said punch member, said injector means closing off the injection port of said die cavity when injecting a slug of malleable metal.

2. The invention as described in claim 1 wherein said die block contains another port through a wall of the die block opposite the wall containing the injection port and in communication with the die block cavity; and a slidably moveable plunger in said second port for closing off said second port.

3. The invention as described in claim 2 wherein said plunger comprises a solid rod.

4. The invention as described in claim 2 wherein said plunger comprises an outer sleeve member having a lengthwise axial bore and a pin member slidably moveable axially in said sleeve member bore.

* * * * *